US009355623B2

(12) United States Patent
Thidell

(10) Patent No.: US 9,355,623 B2
(45) Date of Patent: May 31, 2016

(54) FASTENING DEVICE FOR AN ELECTRIC GUITAR

(71) Applicant: TRUETREMOLO SCANDINAVIA AB, Stockholm (SE)

(72) Inventor: Anders Thidell, Sodertalje (SE)

(73) Assignee: TRUETREMOLO SCANDINAVIA AB, Stockholm (SE)

( * ) Notice: Subject to any disclaimer, the term of this patent is extended or adjusted under 35 U.S.C. 154(b) by 0 days.

(21) Appl. No.: 14/437,653

(22) PCT Filed: Sep. 17, 2013

(86) PCT No.: PCT/SE2013/051081

§ 371 (c)(1),
(2) Date: Apr. 22, 2015

(87) PCT Pub. No.: WO2014/065740

PCT Pub. Date: May 1, 2014

(65) Prior Publication Data

US 2015/0294652 A1 Oct. 15, 2015

(30) Foreign Application Priority Data

Oct. 24, 2012 (SE) ..... 1251200

(51) Int. Cl.

| | |
|---|---|
| ***G10D 3/00*** | (2006.01) |
| ***G10D 3/14*** | (2006.01) |
| ***G10D 1/08*** | (2006.01) |
| ***G10D 3/12*** | (2006.01) |

(52) U.S. Cl.

CPC ..... *G10D 3/146* (2013.01); *G10D 1/085* (2013.01); *G10D 3/12* (2013.01); *G10D 3/14* (2013.01)

(58) Field of Classification Search

CPC ..... G10D 3/146; G10D 1/085; G10D 3/12; G10D 3/14

USPC ..... 84/299

See application file for complete search history.

(56) References Cited

U.S. PATENT DOCUMENTS

| | | | | |
|---|---|---|---|---|
| 7,479,592 | B1 * | 1/2009 | Slavik | G10D 3/146 84/312 R |
| 7,718,873 | B1 | 5/2010 | Slavik | |
| 2004/0134329 | A1 * | 7/2004 | Turner | G10D 3/04 84/298 |

FOREIGN PATENT DOCUMENTS

| | | | |
|---|---|---|---|
| FR | 2 780 542 | A1 | 12/1999 |
| WO | 2007081273 | A1 | 7/2007 |

OTHER PUBLICATIONS

International Search Report, dated Jan. 30, 2014, from corresponding PCT application.

*Primary Examiner* — Jianchun Qin
(74) *Attorney, Agent, or Firm* — Young & Thompson

(57) ABSTRACT

String fastener in the guitar body of an electric guitar, includes a bridge, carrying one saddle per string located at the upper side of the bridge, across which a string is arranged to run, one saddle per string fastened to the upper side, a downwards directed, pivoted lever arranged at each saddle, at which lever one string end is fastened, a tuning spring fastened with one of its ends to the lever and with its other end to the guitar body, which tuning spring strives to maintain a constant pulling force in a string, and which string fastener is provided with a vibrato arm, which when activated results in the bridge angling towards the guitar body, the vibrato arm being pivotally fastened to and running through the bridge. A fastening element maintains each lever in position, and a release device cooperates with the fastening element to release the levers.

17 Claims, 4 Drawing Sheets

FASTENING DEVICE FOR AN ELECTRIC GUITAR

BACKGROUND OF THE INVENTION

1. Field of the Invention

The present invention relates to a device for string instruments, more particularly to a string fastener in the guitar body of an electric guitar.

2. Description of the Related Art

All strings on an electric guitar have, at a desired tuning of the guitar, different coefficients of elasticity as a result of the loading of the strings using the tuning screws. The coefficients of elasticity of the strings correspond to a pulling force in the strings with a certain number of kilos.

For example, a set of electric guitar strings 10-46 has, at normal tuning, the following pull force for the different strings: E 7.35 kg; B 6.98 kg; G 7.53 kg; D 8.34 kg; A 8.84 kg and E 7.94 kg.

A known device is arranged so that each string is fastened to a tuning screw, and in the opposite end is fastened to a lever in a string fastener. A tuning spring is fastened between the lever and the guitar body. The tuning spring is adjustably fastened along the lever.

If a string is affected by some circumstance, such as a temperature modification or a physical impact, the tuning spring compensates, via the lever, the original pull force in the string without the tuning screw having to be adjusted.

Certain guitars are made with so called tremolo designs, designed to perform a vibrato, in other words a pitch alteration via either a slacking of the strings or an increased string tension via a vibrato device. A vibrato device is usually designed so that the string fastener is folded upwards or downwards in relation to the guitar body using a vibrato arm. This results in that the strings are slackened or stretched. A guitar with a vibrato feature does not have any tuning springs; instead the strings are fastened to the string fastener with no resiliency. This results in the disadvantage that the guitar does not keep its tuning after one or several strings have been subjected to some circumstance, such as a temperature shift or physical influences.

Should a vibrato-capable guitar be equipped with tuning springs, the tuning springs would compensate for the altered tension as the tension in the springs are modified as a result of application of vibrato, whereby vibrato effect would completely or partly fail to occur.

BRIEF SUMMARY OF THE INVENTION

The present invention solves this problem, and combines the principle of using tuning springs with a vibrato device.

Hence, the present invention relates to a string fastener in the guitar body of an electric guitar, comprising a bridge, carrying one saddle per string located at the upper side of the bridge, across which a string is arranged to run, wherein one saddle per string is fastened to the upper side of the bridge, wherein a downwards directed, pivoted lever is arranged at each saddle, at which lever one end of a string is arranged to be fastened, wherein a tuning spring, which is a tension spring, is fastened with one of its ends to the lever and with its other end directly or indirectly to the guitar body, which tuning spring strives to maintain a constant pulling force in a string, and which string fastener is provided with a so-called vibrato arm, which when activated results in that the said bridge is angled towards the guitar body, which vibrato arm is pivotally fastened to the bridge and runs through the bridge, and is characterised in that a fastening means is arranged to maintain each of said levers in its respective position relative to the bridge in a normal play state and during vibrato, and in that a release device is arranged to affect the fastening means to release the said levers.

BRIEF DESCRIPTION OF THE DRAWINGS

Below, the invention is described in closer detail, partly in connection to an embodiment of the invention shown in the enclosed drawings, wherein.

DETAILED DESCRIPTION OF THE PREFERRED EMBODIMENTS

Figure 1:
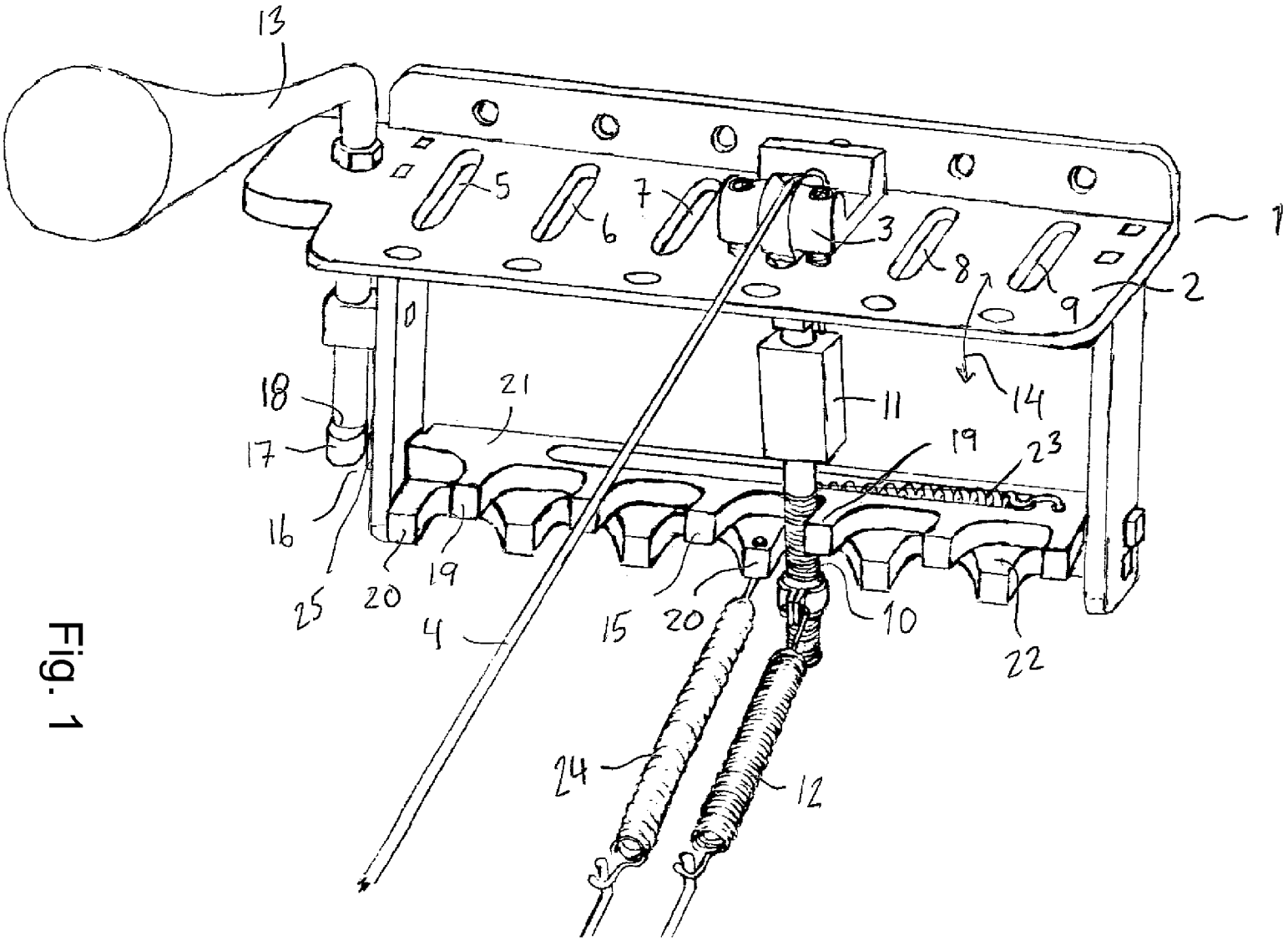
FIG. 1 shows a string fastener and only a fastening means according to a first embodiment according to the invention, in a perspective view

In FIG. 1 is schematically shown a string fastener 1, arranged to be fastened to the guitar body of an electric guitar, not shown. The string fastener comprises a bridge 2 carrying one saddle 3 per string 4, located at the upper side of the bridge, across which a string is arranged to run. In FIG. 1, only one saddle and one string is shown. A respective saddle 3 is to be arranged at each opening 5-9, so that one saddle per string is fastened to the upper side of the bridge 2.

According to a preferred embodiment, each lever 10 is pivotally fastened to a fastener for said saddle 3 about an axis, at which axis the saddle is also fastened, wherein said saddle is semicircle-shaped, where the center of the semicircle coincides with the said axis. This results in that the length of a string between the saddle and the opposite fastening point of the string is constant as the pull force in the string is adjusted using the tuning spring, which strives to maintain the pull force in a string.

A pivoted and downwards directed lever 10 is arranged at each saddle 3, at which lever one end of a string 4 is arranged to be fastened to a fastener 11 which is translatable along the lever.

A tuning spring 12, which is a tension spring, is fastened with one of its ends to each lever 10, and with its other end directly or indirectly to the guitar body. The tuning spring 12 strives to maintain a constant pulling force in a string 4.

The string fastener is provided with a conventional so-called vibrato arm 13, which when activated results in that the said bridge 2 is angled towards the guitar body in the direction of the arrow 14. The vibrato arm 13 is pivotally fastened to the bridge 2, and runs through the bridge through a hole 27 in the same.

According to the invention, there is a fastening means 15, arranged to maintain each of said levers 10 in its respective position relative to the bridge 2 in a normal play state and during vibrato. Moreover, there is a release device 16, which is arranged to affect the fastening means 15 so as to release said levers 10.

When the guitar is tuned and in a normal play state and during vibrato, the fastening means 15 holds the levers 10 fixed in their respective position. This results in that the tensile stress in the strings is not altered by the tuning springs 12, which otherwise would have been the case had the levers not been held fixed. When the vibrato arm is to be maneuvered in the conventional way, so that the bridge 2 is folded, a pitch alteration takes place because of the strings being extended and shortened.

The tensile stress in the strings can be altered during play. By activating the release device 16 to affect the fastening means 15 so as to release the said levers 10, the tuning springs 12 will cause the original tensile stress in the respective strings 4 to be restored, in other words the guitar is tuned to its original tuning state.

Hence, this way a guitar with tuning springs is combined with a vibrato-featured guitar.

According to a preferred embodiment, the release device 16 comprises the vibrato arm 13 and a means 17 which is fastened to the vibrato arm on its free end 18 located on the opposite side of the bridge 2, which means 17 is arranged to, during turning of the vibrato arm in relation to the guitar body to a predetermined position, affect the fastening means 15 to release said levers 10.

According to a first preferred embodiment, the said fastening means 15 comprises, for each lever, two parallel locking arms 19, 20, arranged to abut against each side of the lever 10 when holding the levers fixed.

According to a preferred embodiment, one locking arm out of each pair of locking arms protrudes from a first planar part 21. The second of the locking arms in said pair protrudes from a second planar part 22. The first 21 and the second 22 planar parts are arranged in parallel, and arranged adjacent to each other, so that pairs of locking arms 19, 20 are formed. A tension spring 23 is arranged with a first end fastened to the first planar part 21 and with its other end to the second planar part 22, so that the planar parts 21, 22, when subjected to the spring load, are translated in relation to each other so that each pair of the locking arms 19, 20 is translated into a position in which the levers 10 held fixed.

The said means 17 at the free end 18 of the vibrato arm 13 is arranged to, in a first angular position, the predetermined position, translate the first planar part 21 in relation to the bridge 2, against the spring force of the said spring 23 and also in relation to the second planar part 22, so that the levers 10 are released from the locking arms 19, 20, by the locking arms in each pair of locking arms being distanced from each other. In a second angular position, the said means does not affect the first planar part 21.

Figure 2:
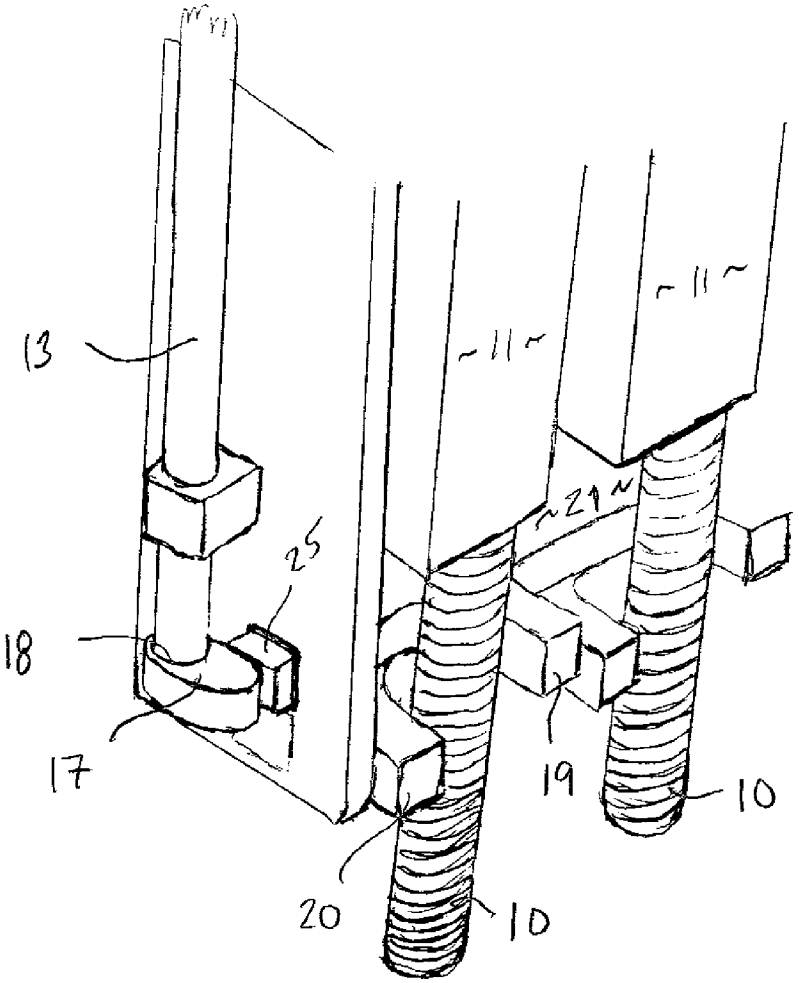
FIG. 2 shows, to a larger scale, the lower left part of the device shown in FIG. 1

It is preferred that the said means 17 is an asymmetric body arranged to act directly onto the first planar part 22, when the vibrato arm 13 is turned to the predetermined position. Suitably, the body is an eccentric body. In FIGS. 1 and 2, a protruding part 25 of the first planar part 21 is shown, against which the said means 17 acts, so that the first planar part 21 is translated.

Hence, a guitarist can turn the vibrato arm to the predetermined position, whereby the levers are released and therefore the tuning springs can, very quickly, result in restored tensile stress in the strings 4.

In FIG. 1, there is also shown a spring 24. The spring 24 is fastened to the second planar part 22 and to the guitar body. The purpose of this spring is to adjust the angle of the bridge 2 in relation to the guitar body in a resting position of the bridge.

Figure 3:
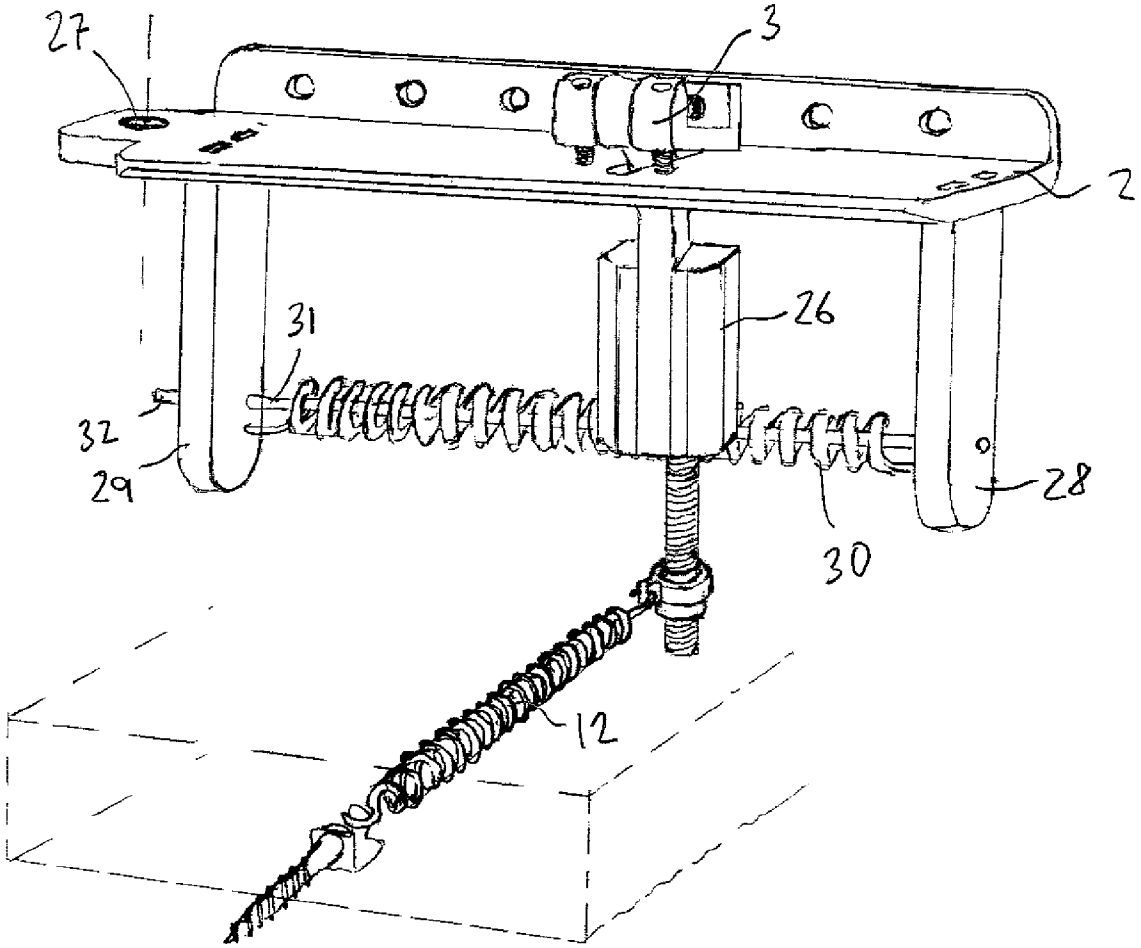
FIG. 3 shows a string fastener and only a body belonging to a fastening means according to a second embodiment according to the invention, in a perspective view
Figure 4:
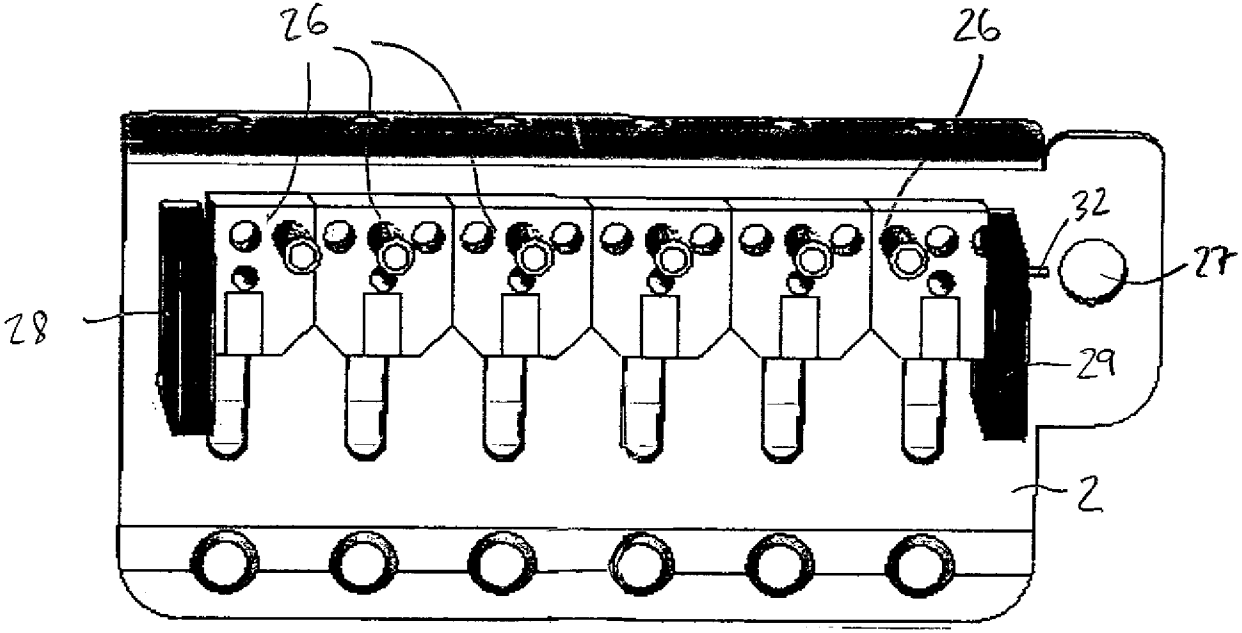
FIG. 4 shows a string fastener as seen from below, with six bodies.

According to a second embodiment of the fastening means, each lever 10 is threaded into a body 26, see FIG. 3. In FIG. 4, a string fastener is shown from below, with six bodies 26, in other words one body per string 4. The hole 27 is that through which the vibrato arm is arranged to run. The bodies 26 are positioned along a line next to each other, with a certain play between adjacent bodies, so that the bodies can move without being affected by neighboring bodies. At the respective ends of the line of bodies 26, there is a respective gable 28, 29 arranged, fastened to the bridge 2. The gables are positioned with a certain play between the respective gable and the side surface of the neighboring body 26. A tension spring 30 is arranged, which is fastened to the respective gables 28, 29 so that the gables strive towards each other, whereby the side surfaces of the bodies 26 are pressed towards each other and towards the respective gable 28, 29 to a position in which the levers 10 are held fixed.

One 28 of the gables is somewhat translatably arranged towards and away from the other gable 29, so that a play between the respective bodies 26 can arise.

The said means 17 at the free end of the vibrato arm 13 is arranged to, in a first predetermined angular position in relation to the bridge 2, translate the said first gable 28, against the spring force of said spring 30, in a direction away from the second gable 29, so that the bodies 26 are released from each other, and in a second angular position not to translate the said gable 28 so that a state is assumed in which the levers 10 are held fixed, by the bodies 26 abutting against each other under the influence of the spring force.

The said means 17 is an asymmetrical body, arranged to act against the free end 31 of a rod 32, which rod 31 is fastened to the first gable 28 and runs to the second gable 29 and out through the same with its free end 32.

In FIG. 3, the vibrato arm is not shown, but it is arranged to run through the hole 27. The lower part of the vibrato arm is therefore designed as shown in FIGS. 1 and 2.

By this second embodiment is achieved the same function as according to the first embodiment, namely that the levers are kept fixed during play and when activating vibrato, and that the levers can be released using a turning of the vibrato arm so that the strings are tuned using the tuning springs.

Above, a number of embodiments have been described. However, it is apparent that the mechanical design of the fastening means can be varied without departing from the function of retaining the levers and releasing the levers, respectively, using turning of the vibrato arm.

Therefore, the invention is not to be regarded as limited to the above described embodiments, but can be varied within the scope of the enclosed claims.

The invention claimed is:

1. A string fastener in a guitar body of an electric guitar, the string fastener comprising:

a bridge carrying one saddle per respective string located at an upper side of the bridge, across which the string is configured to run, the saddle per string being fastened to the upper side of the bridge;

a downwards-directed, pivoted lever disposed at each saddle, one end of the respective string being configured to be fastened at the lever, a tuning spring that is a tension spring being fastened with one of its ends to the lever and with its other end directly or indirectly to the guitar body, the tuning spring being configured to maintain a constant pulling force in the respective string;

a vibrato arm configured, when activated, to cause the bridge to be angled towards the guitar body, the vibrato arm being pivotally fastened to the bridge and running through the bridge;

a lever fastener configured to maintain each of said levers in its respective position relative to the bridge in a normal play state and during vibrato; and a release device configured to affect the lever fastener to release the levers, such that the tuning spring causes an initial tensile stress in the respective string to be restored.

2. The string fastener according to claim 1, wherein the release device comprises the vibrato arm and a vibrato arm fastening device fastened to the vibrato arm on its free end located on the opposite side of the bridge, the vibrato arm fastening device being configured to, during turning of the vibrato arm in relation to the guitar body to a predetermined position, affect the lever fastener to release said levers.

3. The string fastener according to claim 2, wherein one locking arm out of each one of pairs of locking arms protrudes from a first planar part, a second locking arm of the locking arms in said pair protrudes from a second planar part, the first planar part and the second planar part are disposed in parallel and adjacent to each other and translatable in relation to each other, so that the pairs of locking arms are formed, and a planar part spring is disposed with a first end fastened to the first planar part and with its other end fastened to the second planar part so that the planar parts, when spring loaded, are translated in relation to each other so that each pair of the locking arms is translated to a position in which the levers are held fixed.

4. The string fastener according to claim 3, wherein the vibrato arm fastening device at the free end of the vibrato arm is configured to, in a first angular position in relation to the bridge, translate the first planar part against the spring force of the spring in relation to the second planar part so that the levers are released from the locking arms, and in a second angular position, the vibrato arm fastening device does not affect the first planar part.

5. The string fastener according to claim 4, wherein the vibrato arm fastening device is an asymmetric body configured to act directly onto the first planar part.

6. The string fastener according to claim 3, wherein the vibrato arm fastening device is an asymmetric body configured to act directly onto the first planar part.

7. The string fastener according to claim 2, wherein the lever fastener comprises, for each lever, two parallel locking arms configured to abut against each side of the lever when holding the levers fixed.

8. The string fastener according to claim 2, wherein each lever is threaded into a respective body, the bodies being positioned in a line next to each other with play between adjacent bodies so that the bodies move without being affected by neighboring bodies, at the respective ends of the line of bodies, a respective gable is disposed that is fastened to the bridge and positioned with play between the respective gable and a side surface of the neighboring body, a first one of the gables being translatable towards and away from a second one of the gables, a gable tension spring is provided that is fastened to the respective gable so that the gables are tensioned towards each other, the side surfaces of the bodies being pressed towards each other and towards the respective gable to a position in which the levers are held fixed, and the gables are translatable away from each other to a position in which the levers are released.

9. The string fastener according to claim 8, wherein a vibrato arm fastening device provided at the free end of the vibrato arm is configured to, in a first predetermined angular position in relation to the bridge, translate the first gable against the spring force of said gable tension spring in a direction away from the second gable so that the bodies are released from each other, and in a second angular position, the vibrato arm fastening device does not translate the first gable so that a location is assumed in which the levers are held fixed by the bodies abutting against each other.

10. The string fastener according to claim 1, wherein the lever fastener comprises, for each lever, two parallel locking arms configured to abut against each side of the lever when holding the levers fixed.

11. The string fastener according to claim 10, wherein one locking arm out of each one of the pairs of locking arms protrudes from a first planar part, a second locking arm of the locking arms in said pair protrudes from a second planar part, the first planar part and the second planar part are disposed in parallel and adjacent to each other and translatable in relation to each other, so that the pairs of locking arms are formed, and a planar part spring is disposed with a first end fastened to the first planar part and with its other end fastened to the second planar part so that the planar parts, when spring loaded, are translated in relation to each other so that each pair of the locking arms is translated to a position in which the levers are held fixed.

12. The string fastener according to claim 11, further comprising a vibrato arm fastening device at the free end of the vibrato arm that is configured to, in a first angular position in relation to the bridge, translate the first planar part against the spring force of the spring in relation to the second planar part so that the levers are released from the locking arms, and in a second angular position, the vibrato arm fastening device does not affect the first planar part.

13. The string fastener according to claim 1, wherein each lever is threaded into a respective body, the bodies being positioned in a line next to each other with play between adjacent bodies so that the bodies move without being affected by neighboring bodies, at the respective ends of the line of bodies, a respective gable is disposed that is fastened to the bridge and positioned with play between the respective gable and a side surface of the neighboring body, a first one of the gables being translatable towards and away from a second one of the gables, a gable tension spring is provided that is fastened to the respective gable so that the gables are tensioned towards each other, the side surfaces of the bodies being pressed towards each other and towards the respective gable to a position in which the levers are held fixed, and the gables are translatable away from each other to a position in which the levers are released.

14. The string fastener according to claim 13, wherein a vibrato arm fastening device provided at the free end of the vibrato arm is configured to, in a first predetermined angular position in relation to the bridge, translate the first gable against the spring force of said gable tension spring in a direction away from the second gable so that the bodies are released from each other, and in a second angular position, the vibrato arm fastening device does not translate the first gable so that a location is assumed in which the levers are held fixed by the bodies abutting against each other.

15. The string fastener according to claim 14, wherein the vibrato arm fastening device is an asymmetrical body configured to act against the free end of a rod, the rod being fastened to the first gable and running to the second gable and out through the second gable with its free end.

16. The string fastener according to claim 13, further comprising a vibrato arm fastening device that is an asymmetrical body configured to act against the free end of a rod, the rod being fastened to the first gable and running to the second gable and out through the second gable with its free end.

17. The string fastener according to claim 1, wherein each lever is pivotally fastened to a saddle fastener for the saddle about an axis at which the saddle is fastened, and the said saddle is semicircle-shaped, the center of the semicircle coinciding with the axis.

* * * * *